US009681737B2

(12) United States Patent
Gleason

(10) Patent No.: US 9,681,737 B2
(45) Date of Patent: Jun. 20, 2017

(54) SHOULDER STRAP RETENTION DEVICE AND METHOD

(71) Applicant: Mystery Ranch, Bozeman, MT (US)

(72) Inventor: Dana W. Gleason, Bozeman, MT (US)

(73) Assignee: Mystery Ranch, Bozeman, MT (US)

( * ) Notice: Subject to any disclaimer, the term of this patent is extended or adjusted under 35 U.S.C. 154(b) by 0 days.

(21) Appl. No.: 14/845,185

(22) Filed: Sep. 3, 2015

(65) Prior Publication Data

US 2015/0374106 A1 Dec. 31, 2015

Related U.S. Application Data

(63) Continuation of application No. 12/398,906, filed on Mar. 5, 2009, now Pat. No. 9,173,473.

(51) Int. Cl.

| | |
|---|---|
| ***A45F 3/04*** | (2006.01) |
| ***A45C 13/30*** | (2006.01) |
| ***A45F 5/00*** | (2006.01) |
| ***A45F 3/00*** | (2006.01) |
| *A45F 3/06* | (2006.01) |
| *A45F 5/02* | (2006.01) |

(52) U.S. Cl.

CPC ..... *A45F 3/047* (2013.01); *A45C 13/30* (2013.01); *A45F 3/00* (2013.01); *A45F 5/00* (2013.01); *A45F 3/04* (2013.01); *A45F 3/06* (2013.01); *A45F 5/02* (2013.01); *A45F 2003/001* (2013.01); *Y10T 24/318* (2015.01)

(58) Field of Classification Search

CPC .... A45F 3/00; A45F 3/047; A45F 5/00; A45F 3/06; A45F 2003/001; A45F 3/12; A45F 3/04; A45F 5/02; A45F 2005/023; A45C 13/30; Y10T 24/318; Y10T 24/316

USPC ..... 224/259, 261, 262, 263, 264, 638, 641, 224/182, 223, 628, 636, 642, 647, 908, 224/907, 576, 577, 153, 646, 265, 201, 224/189, 242, 650, 272, 660; 2/304, 305, 2/323, 327, 462, 463, 2.5, 96, 102, 459, 2/465, 467, 51, 52, 92, 94, 326, 95; 450/86

See application file for complete search history.

(56) References Cited

U.S. PATENT DOCUMENTS

| | | | | |
|---|---|---|---|---|
| 98,564 A | | 1/1870 | Conklin | |
| 1,401,227 A | | 12/1921 | Wyeth | |
| 2,970,316 A | * | 2/1961 | Silin | A41D 11/00 2/94 |
| 3,717,143 A | * | 2/1973 | Johnson | A61F 5/028 602/19 |
| 4,062,065 A | | 12/1977 | Gardner | |
| 4,106,121 A | | 8/1978 | Belson | |
| 5,072,725 A | * | 12/1991 | Miller | A61F 5/03 128/869 |

(Continued)

*Primary Examiner* — Nathan J Newhouse
*Assistant Examiner* — Matthew Theis
(74) *Attorney, Agent, or Firm* — Lowe Graham Jones PLLC

(57) ABSTRACT

Shoulder strap retention devices that are used to secure the shoulder straps of an article in position relative to a separate chest panel or protector so that they do not slip off the chest panel or the shoulders of a user carrying the article are disclosed. In one embodiment, the shoulder strap retention devices include a retention strap and anchoring strips that are secured to the retention strap and used to attach the shoulder strap retention device to an article having shoulder straps.

23 Claims, 5 Drawing Sheets

(56) References Cited

U.S. PATENT DOCUMENTS

| | | | | |
|---|---|---|---|---|
| 5,181,638 | A | 1/1993 | McHale | |
| 5,240,159 | A * | 8/1993 | Gregory | A45F 3/04 224/264 |
| 5,259,093 | A | 11/1993 | D'Annunzio | |
| 5,265,782 | A | 11/1993 | McNamara | |
| 5,666,701 | A | 9/1997 | Drummond | |
| 5,902,073 | A | 5/1999 | Eungard et al. | |
| 5,961,014 | A * | 10/1999 | Knerr | A45F 3/04 224/153 |
| 6,125,475 | A | 10/2000 | Taylor | |
| 6,182,874 | B1 | 2/2001 | Feldman | |
| 6,681,968 | B2 * | 1/2004 | Zwagerman | A45F 3/15 114/347 |
| 6,793,639 | B2 * | 9/2004 | Gibbs | A61F 5/0585 128/869 |
| 6,808,099 | B2 | 10/2004 | Nykoluk | |
| 6,892,392 | B2 | 5/2005 | Crye et al. | |
| 7,047,570 | B2 | 5/2006 | Johnson | |
| 7,954,172 | B2 | 6/2011 | Hepler | |
| 2003/0057246 | A1 | 3/2003 | Painter | |
| 2005/0015944 | A1 * | 1/2005 | Bergeron | A45F 5/02 24/584.1 |
| 2005/0131322 | A1 | 6/2005 | Harris et al. | |
| 2006/0138188 | A1 | 6/2006 | Kramer | |
| 2007/0289045 | A1 | 12/2007 | Evans et al. | |
| 2009/0206115 | A1 | 8/2009 | Gleason | |

* cited by examiner

SHOULDER STRAP RETENTION DEVICE AND METHOD

CROSS-REFERENCE TO RELATED APPLICATIONS

This application is a continuation of U.S. application Ser. No. 12/398,906 filed Mar. 5, 2009, the contents of which are herein incorporated in its entirety.

FIELD OF THE INVENTION

This invention relates generally to devices and methods for retaining the shoulder straps of an article in position relative to a chest protector or panel.

BACKGROUND OF THE INVENTION

The use of straps that extend over the shoulders to carry backpacks and other articles is commonplace. Such shoulder strap containing articles are extremely useful, particularly for carrying heavier items. In some instances, a shoulder strap containing article is used in conjunction with another article, such as body armor or other chest protectors or panels. However, when used with such a chest protector, the shoulder straps have a tendency to slide off the chest protector as well as the shoulders of a user, which is cumbersome and uncomfortable for the user, particularly over an extended period of time. This is particularly problematic in the case of body armor because the armor nests inside of a vest and creates a thick layer off of which the shoulder straps have a tendency to slide. When the straps slide off the chest protector, they may also tend to cut into the armpit region of the wearer, especially with a heavy load. It would be desirable to secure shoulder straps in position in this situation so that they do not slip off the body armor or other article.

SUMMARY OF THE INVENTION

An apparatus that is used to secure the shoulder straps of an article in position relative to a separate chest panel or protector so that they do not slip off the chest panel or the shoulders of a user carrying the article are disclosed.

In one embodiment, an apparatus is provided for routing a shoulder strap of an article relative to a chest panel worn by a user, the apparatus comprising a shoulder strap retention device that secures to the chest panel and has a portion that routes the shoulder strap of the article to maintain the position of the shoulder strap relative to the chest panel. In certain embodiments, the shoulder strap retention device comprises a retention strap. In further embodiments, the retention strap comprises a first strap section having a first connection fitting and a second strap section having a second connection fitting. In additional embodiments, the retention strap further comprises an adjustment fitting. In other embodiments, the shoulder strap retention device further comprises an anchoring assembly for securing the shoulder strap retention device to the chest panel. In further embodiments, the anchoring assembly comprises a first anchoring strip and a second anchoring strip.

In another embodiment, the shoulder strap retention device comprises a retention strap and an anchoring assembly that includes a first anchoring strip and a second anchoring strip. The retention strap includes a first strap section having a first loop at its left lateral end, a first connection fitting at its medial end and an adjustment fitting and a second strap section having a second loop at its right lateral end and a second connection fitting at its medial end. The first anchoring strip is threaded through the first loop of the first strap section and secured therein. Similarly, the second anchoring strip that is threaded through the second loop of the second strap section and secured therein. The first anchoring strip and the second anchoring strip are used to secure the shoulder strap retention device to a chest protector or panel.

Also provided hereunder are methods for routing a shoulder strap of an article relative to a chest panel worn by a user. The methods include the steps of providing a shoulder strap retention device, securing the shoulder strap retention device to the chest panel and routing the shoulder strap of the article using the shoulder strap retention device to maintain the position of the shoulder strap relative to the chest panel.

In certain embodiments, methods of securing shoulder straps of an article in a desired position relative to a chest panel are provided. The method includes first providing a shoulder strap retention device that includes a retention strap and an anchoring assembly. The retention strap includes a first strap section having a first loop at its left lateral end, a first connection fitting at its medial end and an adjustment fitting and a second strap section having a second loop at its right lateral end and a second connection fitting at its medial end. The anchoring assembly includes a first anchoring strip that is threaded through the first loop of the first strap section and secured therein, and a second anchoring strip that is threaded through the second loop of the second strap section and secured therein. The described shoulder strap retention device is next secured to the chest panel using the first anchoring strip and the second anchoring strip. The first strap section is then looped around one of the shoulder straps of the article and the second strap section is looped around the other shoulder strap of the article. The first strap section and the second strap are then connected using the first connection fitting and the second connection fitting. The length of the retention is next adjusted using the adjustment fitting.

The shoulder strap retention device of the present invention can be attached as an after market accessory to various articles having a chest panel, such as body armor, vests and the like, and used in conjunction with various shoulder strap containing articles, such as backpacks, golf bags and the like. Alternatively, the shoulder strap retention device of the present invention can be attached to or incorporated in the article at the time of manufacture.

Functionally, the shoulder strap retention device of the present invention pulls the shoulder straps of an article towards the center of the body of a user carrying the article. As a result, the shoulder straps of the article are less likely to slip off the chest panel or the shoulders of the user and dig into the armpits of the user, resulting in increased comfort and ease of carrying of the article.

BRIEF DESCRIPTION OF THE DRAWINGS

Preferred and alternative embodiments of the present invention are described in detail below with reference to the following drawings. These depict particular embodiments of the invention and are not intended to limit the scope of the invention as set forth in the claims.

DETAILED DESCRIPTION OF THE PREFERRED EMBODIMENTS

Figure 1:
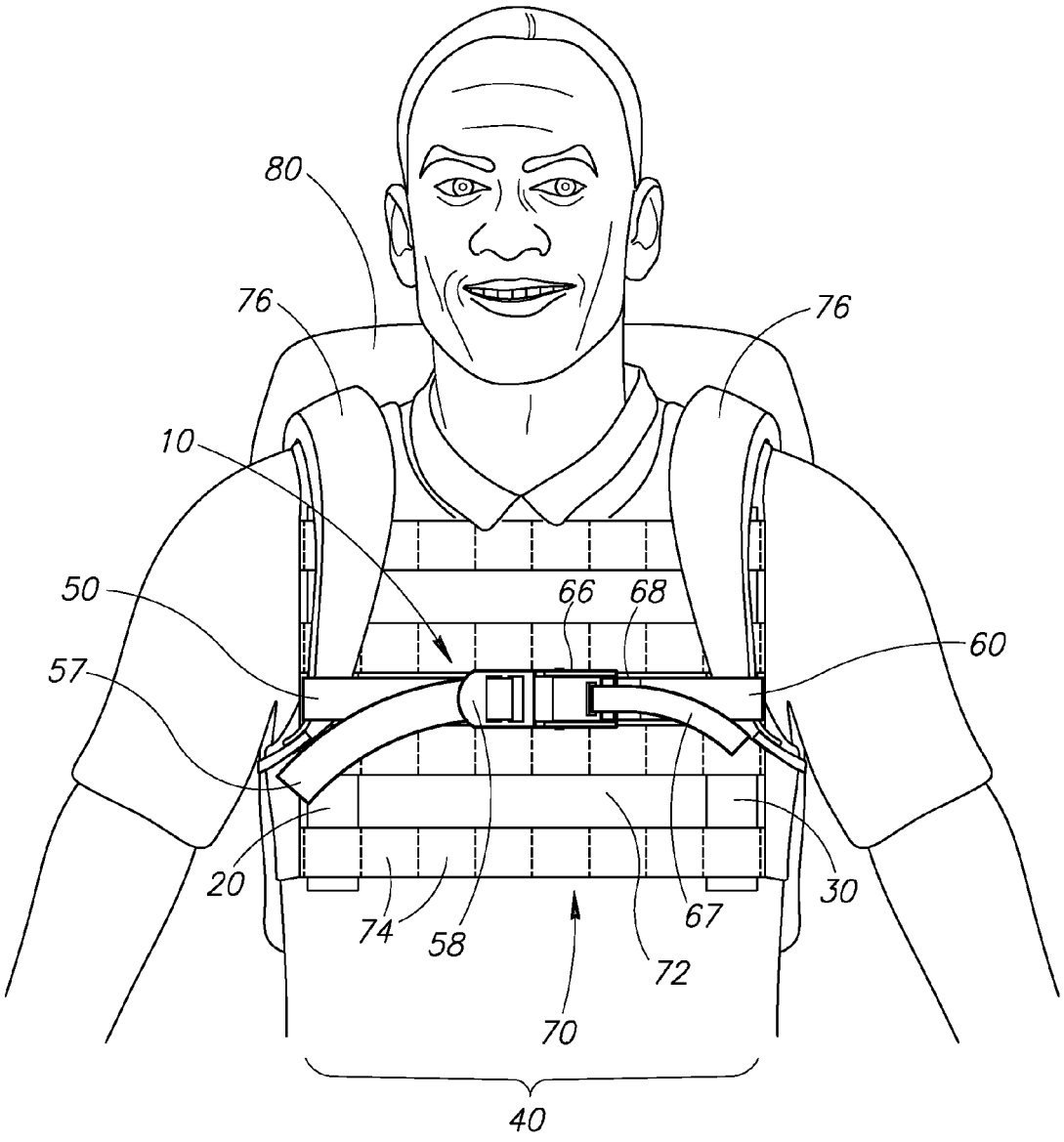
FIG. 1 is a front view of an exemplary shoulder strap retention device mounted on body armor, in accordance with an embodiment of the present invention.

FIG. 1 illustrates the basic configuration of the preferred embodiment of the present invention in use. A backpack 80 with shoulder straps 76 is worn by the user. However, the user also is wearing a separate chest protector, specifically body armor 70. A shoulder strap retention device 10 is provided to properly route shoulder straps 76 and retain them over body armor 70 without slipping off or cutting into the user's armpits. Retention device 10 orients the pack relative to chest panel rather than letting the pack move horizontally or vertically with respect to the chest panel. Note that retention device 10 is anchored to body armor 70, in contrast to prior-art sternum strap devices that simply hold a fixed distance between portions of shoulder straps, but do not secure them to the underlying chest panel or chest protector of the user.

Retention device 10 may interface with any portion of shoulder strap 76, including the upper padded portion or the lower, more narrow portion. Note that herein the shoulder strap is considered to extend from behind the shoulder of the user to its lower attachment to the load-carrying member. Shorter or longer straps, with or without padding or narrow and wide sections are included.

Figure 2:
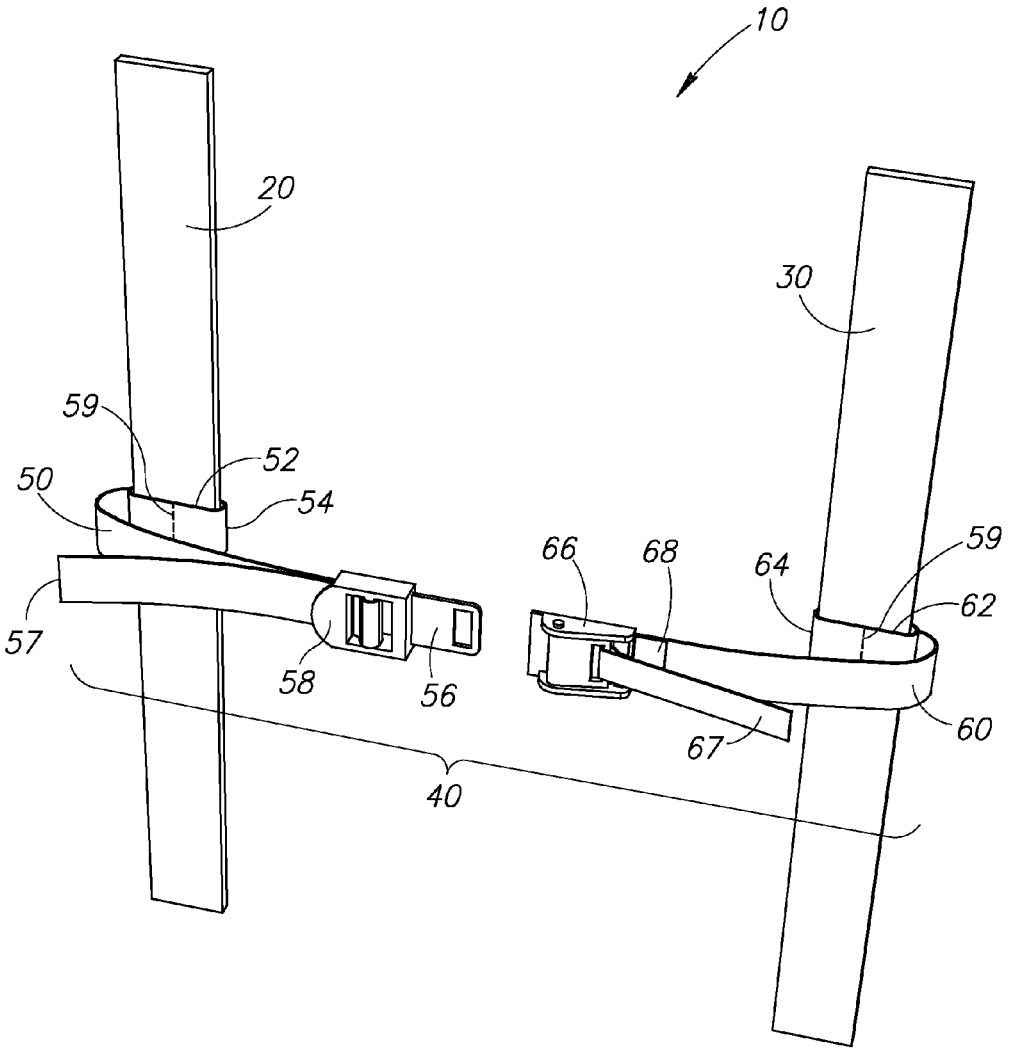
FIG. 2 is a front, perspective view of an exemplary shoulder strap retention device, in accordance with an embodiment of the present invention.

Referring to both FIGS. 1 and 2, the details of the strap retention device 10 are shown. The shoulder strap retention device 10 includes: a first anchoring strip 20; a second anchoring strip 30; a retention strap 40; a first strap section 50 having a first loop 52 at its left lateral end 54, a first connection fitting 56 towards its medial end 57 and an adjustment fitting 58; a second strap section 60 having a second loop 62 at its right lateral end 64 and a second connection fitting 66 towards its medial end 68; a quick release strap 67; and tacking 59. The body armor 70 includes a front panel 72 having a plurality of loops 74 stitched thereto.

To mount the shoulder strap retention device 10 to the body armor 70, the first anchoring strip 20, having the first strap section 50 attached thereto, and the second anchoring strip 30, having the second strap section 60 attached thereto, are threaded through loops 74 located on opposite sides of the front panel 72 of the body armor 70. The first strap section 50 and the second strap section 60 are then looped around the shoulder straps 76 and connected using the first connection fitting 56 and the second connection fitting 66. The length of the retention strap 40 is then adjusted using the adjustment fitting 58.

As set forth above, the shoulder strap retention device 10 includes the first anchoring strip 20, the second anchoring strip 30, and the retention strap 40. In the illustrated embodiment, the retention strap 40 includes the first strap section 50 and the second strap section 60. The first strap section 50 has the first loop 52 at the left lateral end 54 and the first connection fitting 56 towards the medial end 57. The first strap section 50 also includes the adjustment fitting 58 for adjusting the length of the retention strap 40. The second strap section 60 has the second loop 62 at the right lateral end 64 and the second connection fitting 66 towards the medial end 68 that couples with the connection fitting 56. Also included in the illustrated embodiment is the quick release strap 67. The first anchoring strip 20 is threaded through the first loop 52 of the first strap section 50 and secured thereto using the tacking 59. Similarly, the second anchoring strip 30 is threaded through the second loop 62 of the second strap section 60 and secured thereto using the tacking 59. In alternate embodiments, the first strap section 50 and the second strap section 60 can be secured to the first anchoring strip 20 and the second anchoring strip 30, respectively, using rivets, snaps, glue and the like. In additional embodiments, the first anchoring strip 20 is threaded through the first loop 52 and the second anchoring strip 30 is threaded through the second loop 62 without being secured thereto. In further embodiments, the tacking 59 is eliminated and the first anchoring strip 20 and the second anchoring strip 30 are secured directly to a chest panel using tacking, rivets, glue, snaps and the like.

Various materials can be used to make the different components of the shoulder strap retention device 10. Suitable materials that can be used to make the first strap section 50 and the second strap section 60 of the retention strap 40 include, for example, plastics, fabrics such as nylon, polyester, and polypropylene, and the like. In a preferred embodiment, strap sections 50 and 60 are nylon webbing. In general, the material used to make the retention strap 40 can be any flexible or fabric material, including any natural or man-made woven material. The retention strap 40 can range from about 15 millimeters to about 40 millimeters in width and from about 0.5 millimeter to about 3 millimeters in thickness and in general are sized to fit between loop strips of a chest panel such as the front panel 72 of the body armor 70, for example. The retention strap 40 can be various shapes, including a ribbon, a strip, a rope and the like.

Suitable materials that can be used to make the first anchoring strip 20 and the second anchoring strip 30 include, for example, plastics, such as polyethylene and nylon, and metals. If desired, the surface of the first anchoring strip 20 and the second anchoring strip 30 can be covered with a material such as a fabric material to give them a desired appearance. In general, the material used to make the first anchoring strip 20 and the second anchoring strip 30 must be rigid enough to hold the retention strap 40 in place but flexible enough so that it can be properly positioned on the article on which it is to be mounted or attached. The first anchoring strip 20 and the second anchoring strip 30 can range from about 15 millimeters to about 40 millimeters in width, from about 1 millimeters to about 8 millimeters in thickness. The anchoring strips 20, 30 have lengths preferably between 50 millimeters and 23 centimeters. The anchoring strips 20, 30 are, in general, sized to fit in the loops of a chest panel such as the font panel 72 of the body armor 70 (such as the MOLLE or PAL systems currently in use in various military units.)

The first connection fitting 56, the adjustment fitting 58 and the second connection fitting 66 are common structures generally known in the art and are typically made of plastic or metal. The size of the first connection fitting 56, the adjustment fitting 58 and the second connection fitting 66 will vary depending on and be compatible with the size of the retention strap 40.

Figure 3:
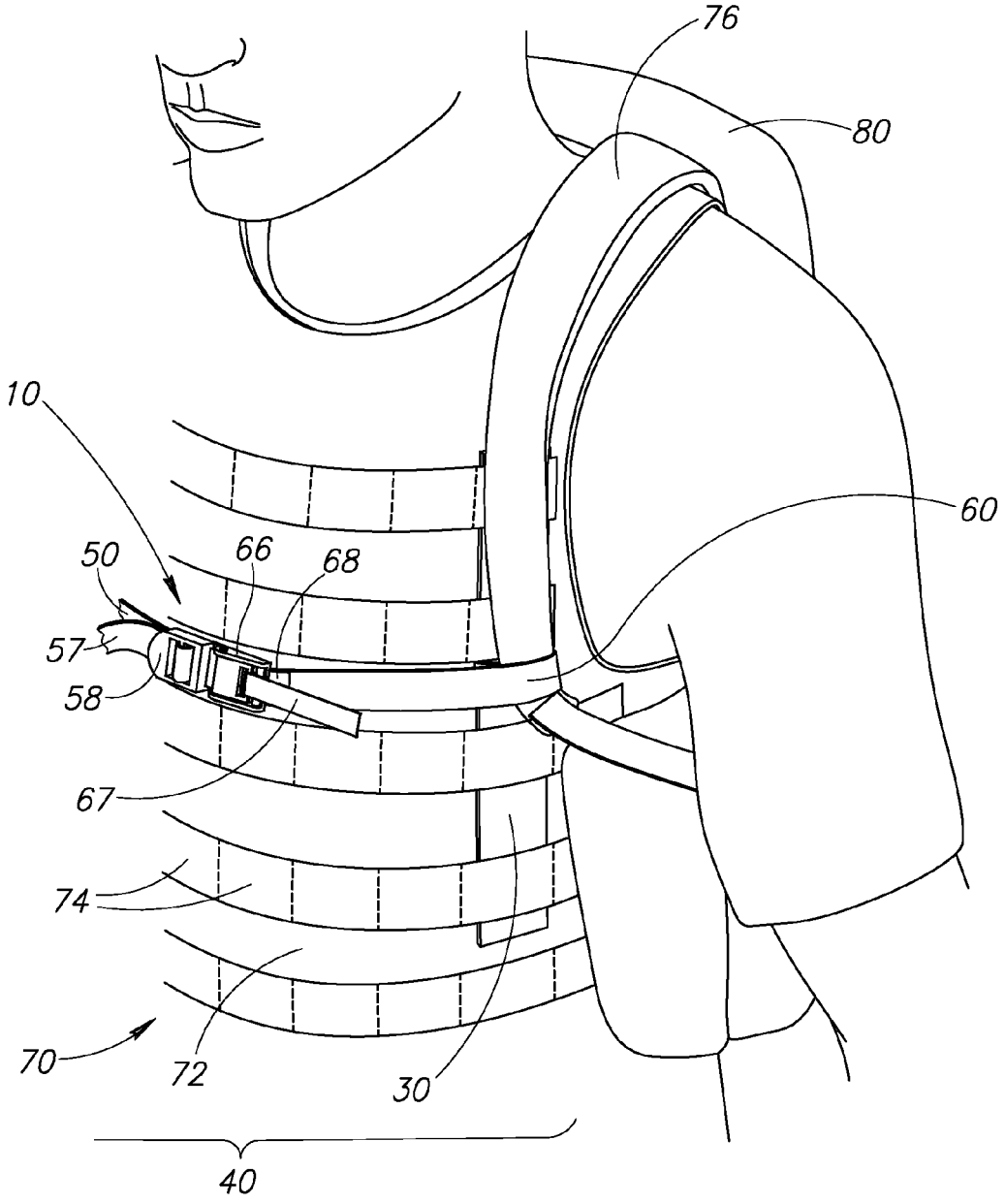
FIG. 3 is a perspective view of an exemplary shoulder strap retention device mounted on body armor, in accordance with an embodiment of the present invention.

Referring now to FIG. 3, a perspective view of the shoulder strap retention device 10 mounted on body armor 70, in accordance with an embodiment of the present invention, is shown. As set forth above, the shoulder strap retention device 10 includes: the first anchoring strip 20 (FIG. 2); the second anchoring strip 30; the retention strap 40; the first strap section 50 having the first loop 52 (FIG. 2) at the left lateral end 54 (FIG. 2), the first connection fitting 56 (FIG. 2) towards the medial end 57 and the adjustment fitting 58; the second strap section 60 having the second loop 62 (FIG. 2) at the right lateral end 64 (FIG. 2) and the second connection fitting 66 towards the medial end 68; the quick release strap 67; and the tacking 59 (FIG. 2). As set forth above, the body armor 70 includes the front panel 72 having the plurality of loops 74 stitched thereto, the shoulder straps 76 and the backpack 80. The shoulder strap retention device 10 has been mounted to the body armor 70 in the manner set forth above. The shoulder strap retention device 10 loops around the shoulder strap 76, pulls the shoulder strap 76 inward and routes the shoulder strap 76 away from the armpit of the user. As a result, movement of the shoulder strap 76 is limited and the shoulder strap 76 is less likely to slip off the shoulder of the user or cause discomfort to the user by digging into the user's armpit.

Figure 4:
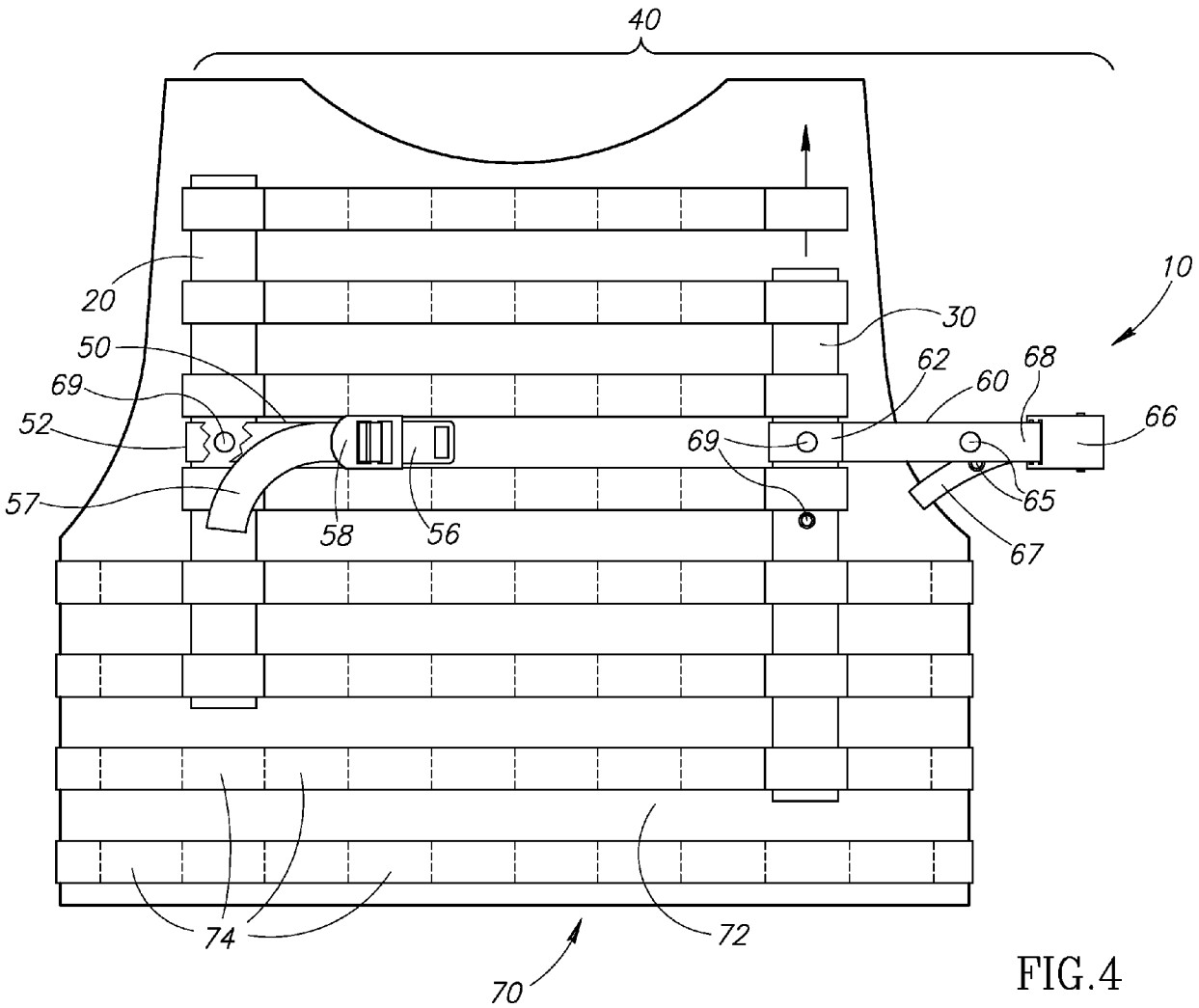
FIG. 4 is a front view of an alternate embodiment of a shoulder strap retention device in the process of being mounted on body armor, in accordance with the present invention.
Figure 5:
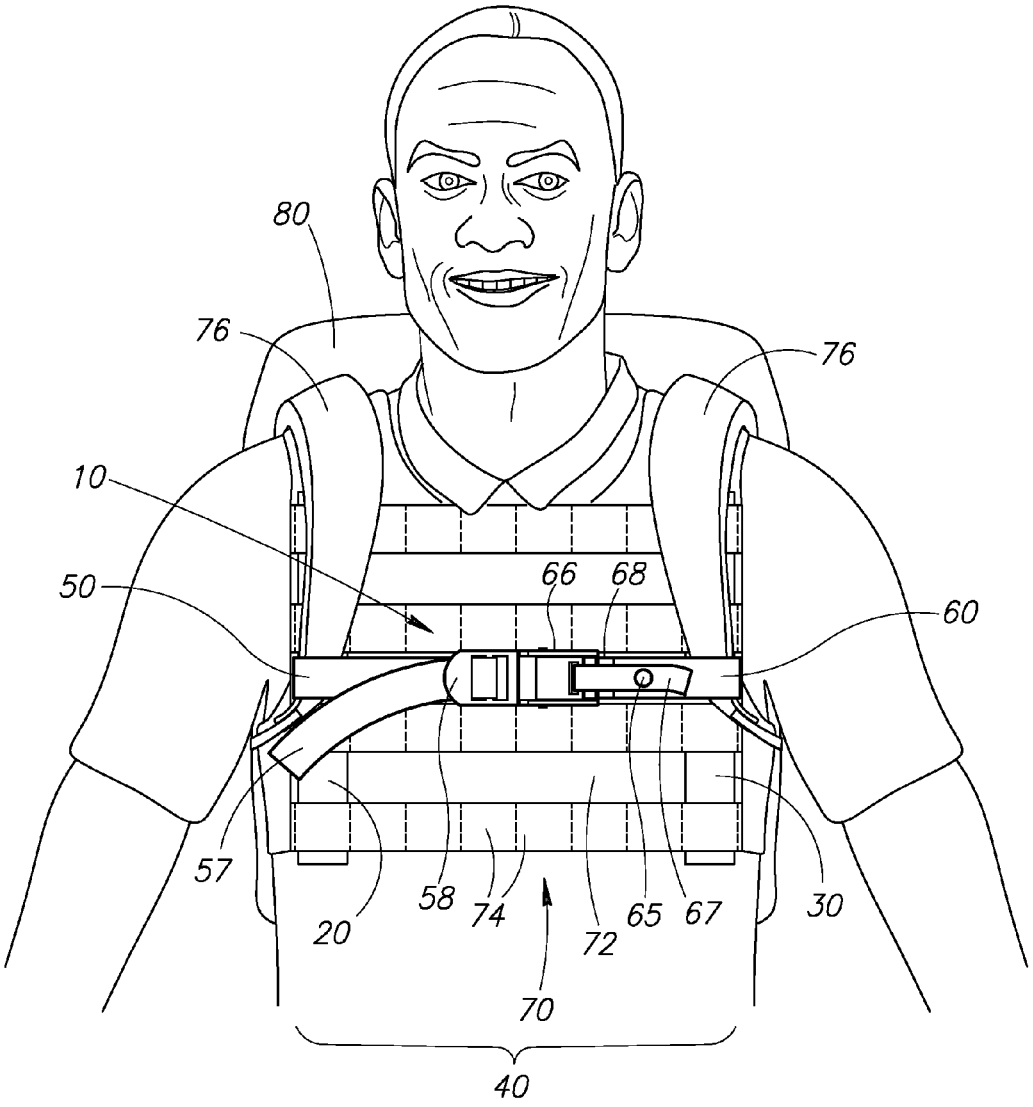
FIG. 5 is a front view of the alternate embodiment of a shoulder strap retention device of FIG. 4 mounted on body armor, in accordance with the present invention.

Referring now to FIG. 4, a front view of an alternate embodiment of a shoulder strap retention device 10 of the present invention in the process of being mounted on body armor 70 is shown. As set forth above, the shoulder strap retention device 10 includes: the first anchoring strip 20; the second anchoring strip 30; the retention strap 40; the first strap section 50 having the first loop 52 at the left lateral end 54 (FIG. 2), the first connection fitting 56 towards the medial end 57 and the adjustment fitting 58; and the second strap section 60 having the second loop 62 at the right lateral end 64 (FIG. 2) and the second connection fitting 66 towards the medial end 68. As set forth above, the body armor 70 includes the front panel 72 having the plurality of loops 74 stitched thereto, the shoulder straps 76 and the backpack 80 (FIG. 5). In the alternate embodiment shown in FIG. 4, the first anchoring strip 20, the second anchoring strip 30, the first strap section 50 and the second strap section 60 contain snaps 69 for securing the first strap section 50 to the first anchoring strip 20 and the second strap section 60 to the second anchoring strip 30. In the illustrated embodiment, a fabric material covers the first anchoring strip 20 and the second anchoring strip 30. Also included in the illustrated embodiment is a quick release strap 67 that is secured to the second strap section 60 using a snap 65. To mount the shoulder strap retention device 10 to the body armor 70, the first anchoring strip 20 is threaded through the first loop 52 of the first strap section 50 and through the loops 74 located on the front panel 72 of the body armor 70 and the second anchoring strip 30 is threaded through the second loop 62 of the second strap section 60 and through the loops 74 located on the opposite side of the front panel 72 of the body armor 70. The first strap section 50 and the second strap section 60 are then secured to the first anchoring strip 20 and the second anchoring strip 30 using the snaps 69. The first strap section 50 and the second strap section 60 are next looped around the shoulder straps 76 (FIG. 5) and connected using the first connection fitting 56 and the second connection fitting 66. The length of the retention strap 40 is then adjusted using the adjustment fitting 58.

Referring now to FIG. 5, a front view of the alternate embodiment of the shoulder strap retention device 10 of FIG. 4 that has been mounted on body armor 70 is shown. As set forth above, the shoulder strap retention device 10 includes: the first anchoring strip 20 having the fabric covering; the second anchoring strip 30 having the fabric covering; the retention strap 40; the first strap section 50 having the first loop 52 (FIG. 4) at the left lateral end 54 (FIG. 2), the first connection fitting 56 (FIG. 4) towards the medial end 57 and the adjustment fitting 58; the second strap section 60 having the second loop 62 (FIG. 4) at the right lateral end 64 (FIG. 2) and the second connection fitting 66 towards the medial end 68; the quick release strap 67; the snap 65; and the riveted snaps 69 (FIG. 4). Hook-and-loop fasteners may be used in place of snaps 69. As set forth above, the body armor 70 includes the front panel 72 having the plurality of loops 74 stitched thereto, the shoulder straps 76 and the backpack 80. The shoulder strap retention device 10 is mounted on the body armor 70 in the manner set forth above. As discussed above, the shoulder strap retention device 10 loops around the shoulder straps 76, pulls the shoulder straps 76 inward and routes the shoulder straps 76 away from the armpit of the user. As a result, movement of the shoulder straps 76 is limited and the shoulder straps 76 are less likely to slip off the shoulders or chest protector of the user or cause discomfort to the user by digging into the user's armpits.

Although specific embodiments have been illustrated and described herein, it will be appreciated by those of ordinary skill in the art and others, that a wide variety of alternate and/or equivalent implementations may be substituted for the specific described embodiments without departing from the scope of the present invention. For example, while the embodiments illustrated in FIGS. 1 and 3 to 5 show the shoulder strap retention device 10 mounted on body armor 70, it should be understood that shoulder strap retention device of the present invention can be adapted for use with a wide variety of articles having shoulder straps, including vests, backpacks, golf club bags, and the like or with a wide variety of articles having chest panels, such as chest protectors used in motorsports or articles of clothing, such as shirts or vests. As another example, while the embodiments illustrated in FIGS. 1 and 3 to 5 show the shoulder strap retention device 10 mounted on the body armor 70 using the first anchoring strip 20 and the second anchoring strip 30, it should be understood that other ways of attaching the shoulder strap retention device 10 to an article can be used. For example, the first anchoring strip 20 and the second anchoring strip 30 can be eliminated and the retention strap 40 can be sewn directly on the article, either at the time of manufacture or as an after-market accessory. As a further example, while the embodiments illustrated in FIGS. 1 to 5 show a two-piece retention strap 40, it should be understood that a single piece retention strap can be used if the article on which it is to be mounted has detachable or multi-piece shoulder straps. This application is intended to cover any adaptations or variations of the embodiments discussed herein.

The embodiments of the invention in which an exclusive property or privilege is claimed are defined as follows:

1. A shoulder strap retention device for retaining a shoulder strap secured to an article in a predetermined position relative to a chest plate worn by a user, the shoulder strap including first and second portions secured to the article and a middle portion extending between the first and second portions retention device comprising:

a retention strap comprising a first strap section having a first loop at its left lateral end, a first connection fitting at its medial end and an adjustment fitting and a second strap section having a second loop at its right lateral end and a second connection fitting at its medial end, the second connection fitting configured to selectively secure to the first connection fitting;

a first anchoring strip that is threaded through the first loop of the first strap section and secured therein, wherein the first anchoring strip includes a first anchoring mechanism, the first anchoring mechanism configured to secure the first anchoring strip to the chest plate having the chest plate positioned between the middle portion and the article, the first anchoring mechanism comprising a first portion of the first anchoring strip that protrudes out of a first side of the first loop and a second portion of the first anchoring strip that protrudes out of a second side of the first loop opposite the first side of the first loop; and a second anchoring strip that is threaded through the second loop of the second strap section and secured therein, wherein the second anchoring strip includes a second anchoring mechanism, the second anchoring mechanism configured to secure the second anchoring strip to the chest plate such that the first anchoring strip and the second anchoring strip are secured to the chest plate independently of the shoulder strap of the article, having the chest plate positioned between the first and second anchoring strips and the article-and positioned between the middle portion and the article, the second anchoring mechanism comprising a first portion of the second anchoring strip that protrudes out of a first side of the second loop and a second portion of the second anchoring strip that protrudes out of a second side of the second loop opposite the first side of the second loop;

wherein the first and second anchoring strips each comprise an oblong strip of at least semi-rigid material having ends separated along a long dimension of the oblong strip that are not attached to any other structure.

2. The shoulder strap retention device of claim 1 wherein the first strap section and the second strap section are a fabric material or a plastic.

3. The shoulder strap retention device of claim 2 wherein the first strap section and the second strap section are nylon, polyester, or polypropylene.

4. The shoulder strap retention device of claim 1 wherein the first strap section and the second strap section are fabric strips having a width of about 10 millimeters to about 37 millimeters and a thickness of about 0.5 millimeter to about 3 millimeters.

5. The shoulder strap retention device of claim 1 wherein the first connection fitting, the second connection fitting and the adjustment fitting are metal or plastic.

6. The shoulder strap retention device of claim 1 wherein the first anchoring strip and the second anchoring strip are metal or plastic.

7. The shoulder strap retention device of claim 6 wherein the first anchoring strip and the second anchoring strip are polyethylene strips.

8. The shoulder strap retention device of claim 7 wherein the polyethylene strips covered with a fabric material.

9. The shoulder strap retention device of claim 4 wherein the first anchoring strip and the second anchoring strip are polyethylene strips having a width of about 15 millimeters to about 40 millimeters and a thickness of about 1 millimeter to about 8 millimeters and strip lengths between 50 millimeters to 23 centimeters.

10. The shoulder strap retention device of claim 1 wherein the first anchoring strip is secured to the first strap section and the second anchoring strip is secured to the second strap section using tacking, rivets, glue or snaps.

11. The shoulder strap retention device of claim 10 wherein the first anchoring strip is secured to the first strap section and the second anchoring strip are secured to the second strap section using snaps.

12. A retention apparatus for routing a shoulder strap secured to a back pack over the front of a protective chest panel worn by a user, the shoulder strap including first and second end portions secured to the back pack and a middle portion extending between the first and second end portions, the apparatus comprising:

an attachment portion having an anchoring mechanism securable to the chest panel independently of the back pack and on an opposite side of the chest panel from the back pack to hold in place the retention apparatus relative to the user; and a routing portion extending outwardly from the attachment portion, the routing portion being configured to interface with the shoulder strap forward of the armpit of the user to route the shoulder strap relative to the chest panel and maintain the position of the shoulder strap relative to the chest panel having the shoulder strap extending over a front surface of the chest panel having the chest panel positioned between the middle portion and the backpack;

wherein the attachment portion comprises a semi-rigid strip configured to engage with the chest panel to maintain the attachment portion in place relative to the chest panel;

wherein the semi-rigid strip comprises an oblong strip having ends separate along a long dimension of the oblong strip that are not secured to any other structure, a major portion of the oblong strip protrudes outwardly from the routing portion a length sufficient to engage attachment structures of the chest panel.

13. The retention apparatus of claim 12 wherein the routing portion comprises at least one strap extending from the attachment portion and configured to engage the shoulder strap of the back pack.

14. The retention apparatus of claim 12 wherein the routing portion comprises a right-hand portion positioned to engage a right-hand shoulder strap of the back pack, the right-hand portion comprising a first connector portion, and a left-hand portion positioned to engage a left-hand shoulder strap of the back pack, the left-hand portion comprising a second connector portion, and wherein the right-hand portion and left-hand portion and first connector portion and left hand connector portion are configured to maintain the shoulder straps in position relative to the chest panel.

15. The retention apparatus of claim 12 wherein the routing portion is configured to maintain the shoulder straps relative to the chest panel such that the shoulder straps bear upon the chest panel and not upon the shoulders of a user.

16. The shoulder strap retention device of claim 1, further comprising:

a first fastening element secured to a center of the first anchoring strip;

a second fastening element secured to a center of the second anchoring strip;

a third fastening element secured to the first loop and facing inwardly in the first loop, the third fastening element selectively securing to the first fastening element; and a fourth fastening element secured to the second loop and facing inwardly in the first loop, the fourth fastening element selectively securing to the second fastening element.

17. The shoulder strap retention device of claim 16, wherein the first, second, third, and fourth fastening elements are snap fastening elements.

18. A shoulder strap retention device for retaining a shoulder strap secured to an article in a predetermined position relative to a chest plate worn by a user, the shoulder strap including first and second portions secured to the article and a middle portion extending between the first and second portions retention device comprising:

a retention strap comprising a first strap section having a first loop at its left lateral end, a first connection fitting at its medial end and an adjustment fitting and a second strap section having a second loop at its right lateral end and a second connection fitting at its medial end, the second connection fitting configured to selectively secure to the first connection fitting;

a first anchoring strip that is threaded through the first loop of the first strap section and secured therein having a major portion of the first anchoring strip protruding outwardly on either side of the first loop, wherein the first anchoring strip includes an anchoring mechanism, the anchoring mechanism configured to secure the first anchoring strip to the chest plate having the chest plate positioned between the middle portion and the article; and a second anchoring strip that is threaded through the second loop of the second strap section and secured therein having a major portion of the second anchoring strip protruding outwardly on either side of the second loop, wherein the second anchoring strip includes an anchoring mechanism, the anchoring mechanism configured to secure the second anchoring strip to the chest plate such that the first anchoring strip and the second anchoring strip are secured to the chest plate independently of the shoulder strap of the article, having the chest plate positioned between the first and second anchoring strips and the article and positioned between the middle portion and the article;

a first fastening element secured to a center of the first anchoring strip;

a second fastening element secured to a center of the second anchoring strip;

a third fastening element secured to the first loop and facing inwardly in the first loop, the third fastening element selectively securing to the first fastening element; and a fourth fastening element secured to the second loop and facing inwardly in the first loop, the fourth fastening element selectively securing to the second fastening element.

19. The shoulder strap retention device of claim 18, wherein the first, second, third, and fourth fastening portions are snap fastening elements.

20. A method comprising:

providing a retention strap comprising a first strap section having a first loop at its left lateral end, a first connection fitting at its medial end and an adjustment fitting and a second strap section and a second loop at its right lateral end and a second connection fitting at its medial end, the second connection fitting configured to selectively secure to the first connection fitting;

providing a first anchoring strip;

threading the first anchoring strip through the first loop of the first strap section such that a major portion of the second anchoring strip protrudes on either side of the second loop;

anchoring the first anchoring strip to a chest plate worn by a user;

providing a second anchoring strip;

threading the second anchoring strip through the second loop of the second strap section such that a major portion of the second anchoring strip protrudes on either side of the second loop;

anchoring the first anchoring strip to the chest plate; and securing the first connection fitting to the second fitting such that the first strap passes from the anchoring strip, around a first shoulder strap secured to an article worn by the user, to the first connection fitting;

the second strap passes from the anchoring strip, around a second shoulder strap secured to the article, to the second fitting; and the first and second straps draw the first and second shoulder straps toward one another having the user positioned between the chest plate and the article and the chest plate positioned between the user and all of the first and second anchoring strips and the first and second connection fittings.

21. The method of claim 20, wherein the first and second anchoring strips each comprise an oblong strip of at least semi-rigid material having ends separated along a long dimension of the oblong strip that are not attached to any other structure.

22. The method of 20, further comprising fastening the first anchoring strip to the first loop and fastening the second anchoring strip to the second loop.

23. The method of claim 22, wherein fastening the first anchoring strip to the first loop comprises engaging first snap fastening elements and fastening the second anchoring strip to the second loop comprises engaging second snap fastening elements.

* * * * *